US007714793B2

(12) United States Patent
Eguchi et al.

(10) Patent No.: US 7,714,793 B2
(45) Date of Patent: May 11, 2010

(54) HIGH-FREQUENCY MAGNETIC MATERIAL AND ANTENNA SYSTEM USING THEREOF

(75) Inventors: Tomoko Eguchi, Tokyo (JP); Maki Yonetsu, Tokyo (JP); Naoyuki Nakagawa, Kanagawa (JP); Seiichi Suenaga, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 72 days.

(21) Appl. No.: 12/194,677

(22) Filed: Aug. 20, 2008

(65) Prior Publication Data

US 2009/0079650 A1 Mar. 26, 2009

(30) Foreign Application Priority Data

Sep. 20, 2007 (JP) ..... 2007-243899

(51) Int. Cl.
*H01Q 1/00* (2006.01)

(52) U.S. Cl. ..... 343/787; 343/793; 428/693.1

(58) Field of Classification Search ..... 343/787, 343/793; 428/693.1, 188, 323, 119
See application file for complete search history.

(56) References Cited

U.S. PATENT DOCUMENTS 6,110,609 A * 8/2000 Hiramoto et al. ..... 428/812
7,369,027 B2 * 5/2008 Choi et al. ..... 336/200
2006/0050444 A1 * 3/2006 Fukuzawa et al. ..... 360/324
2008/0166592 A1 7/2008 Yonetsu et al.
2009/0058750 A1 * 3/2009 Eguchi et al. ..... 343/787

FOREIGN PATENT DOCUMENTS

JP 7-249518 9/1995

OTHER PUBLICATIONS

S. Ohnuma, et al., "High-Frequency Magnetic Properties in Metal-Nonmetal Granular Films (Invited)", Journal of Applied Physics, Apr. 15, 1996, vol. 79 No. 8, pp. 5130-5135.
Naoto Hayashi, et al., "Soft Magnetic Properties and Microstructure of $Ni_{81}Fe_{19}$/ $(Fe_{70}Co_{30})_{99}$ $(Al_2O_3)_1$ Films Deposited by Ion Beam Sputtering", Transactions of the Materials Research Society of Japan, vol. 94 No. 4, 2004, pp. 1611-1614.
U.S. Appl. No. 12/174,016, filed Jul. 16, 2008, Tomoko Eguchi, et al.

* cited by examiner

*Primary Examiner*—HoangAnh T Le
(74) *Attorney, Agent, or Firm*—Oblon, Spivak, McClelland, Maier & Neustadt, L.L.P.

(57) ABSTRACT

A superior high-frequency magnetic material having a smaller ratio (μ"/μ') of a real part μ' of permeability and an imaginary part μ" of permeability in a high-frequency region and an antenna system using thereof are provided. The high-frequency magnetic material includes a substrate and a composite magnetic film formed on the substrate and made of a magnetic phase forming a plurality of columnar bodies whose longitudinal direction is directed in a direction perpendicular to a surface of the substrate and an insulator phase filling gaps of the columnar bodies. The magnetic phase contains at least one of Nb, Zr, and Hf, and Fe and B, is amorphous, and has in-plane uniaxial anisotropy of Hk2/Hk1≧3 and Hk2≧3.98×$10^3$ A/m when a minimal anisotropic magnetic field in a plane parallel to the surface of the substrate is Hk1 and a maximal anisotropic magnetic field is Hk2.

20 Claims, 5 Drawing Sheets

HIGH-FREQUENCY MAGNETIC MATERIAL AND ANTENNA SYSTEM USING THEREOF

CROSS-REFERENCE TO RELATED APPLICATION

This application is based upon and claims the benefit of priority from Japanese Patent Application No. 2007-243899, filed on Sep. 20, 2007, the entire contents of which are incorporated herein by reference.

FIELD OF THE INVENTION

The present invention relates to a high-frequency magnetic material and an antenna system using thereof.

BACKGROUND OF THE INVENTION

High frequencies such as a GHz band are used as a frequency band of radio waves used by current mobile devices. However, for example, if a metal is present near an antenna of a mobile device when the antenna radiates electromagnetic waves, radiation of electromagnetic waves is disturbed due to an induced current generated in the metal. Thus, by arranging a high-frequency magnetic material (a material that exhibits high permeability in a high-frequency region) near the antenna to suppress generation of an unnecessary induced current, stability in radio frequency communication in a high-frequency region is believed to be achievable.

Metals or alloys having Fe, Co, Ni or the like as main components, or oxides thereof are used as ordinary high permeability members. High permeability members of metal or alloy are not appropriate as high-frequency magnetic materials because transmission losses caused by an eddy current of radio waves become more pronounced as the frequency of radio waves increases.

Magnetic materials of oxide exemplified by ferrite, on the other hand, suppress transmission losses caused by an eddy current because of high resistivity, but the resonance frequencies are several hundred MHz and transmission losses caused by resonance in a high-frequency region higher than these frequencies become more pronounced and therefore, magnetic materials of oxide are not appropriate as high-frequency magnetic materials either.

Thus, development of a high-frequency magnetic material superior in magnetic properties in a high-frequency region up to the GHz band is demanded. A superior high-frequency magnetic material is a material that has high resistivity, a large real part μ' of permeability, and a small imaginary part μ" of permeability showing a loss component of permeability, that is, small "μ"/μ'" in a high-frequency region.

As an attempt to produce such a high-frequency magnetic material, a high permeability nano-granular material having a granular structure using a thin film technology such as a sputtering method has been made. Here, the granular structure is a structure in which magnetic metal fine particles are dispersed in an insulating matrix and it has been confirmed that such a structure exhibits superior properties also in a high-frequency region (for example, S. Ohmura et al., "High-frequency magnetic properties in metal-nonmetal granular films", Journal of Applied Physics 79(8) pp. 5130-5135 (1996)). However, with the granular structure, it is difficult to make permeability still higher by improving volume percentage of magnetic metal fine particles in a high-frequency magnetic material.

Also, a high permeability material in a high frequency region having a columnar structure has been produced whose volume percentage of magnetic metals is further improved from that of the granular structure. This is a structure in which magnetic metals in a columnar shape are dispersed in an insulating matrix and it has been confirmed that this structure exhibits higher permeability than the granular structure (for example, N. Hayashi et al., "Soft Magnetic Properties and Microstructure of $Ni_{81}Fe_{19}/(Fe_{70}CO_{30})_{99}(Al_2O_3)_1$) Films Deposited by Ion Beam Sputtering", Transaction of the Materials Research Society of Japan 29 [4] pp. 1611-1614 (2004)).

However, materials having the columnar structure have large magnetic anisotropic dispersion caused by a disturbance of crystalline orientation or the like and thus, there is a problem that a loss component μ" in a high-frequency region is large and μ"/μ' is also large.

SUMMARY OF THE INVENTION

A high-frequency magnetic material in an aspect of the present invention includes a substrate and a composite magnetic film formed on the substrate and made of a magnetic phase forming a plurality of columnar bodies whose longitudinal direction is directed in a direction perpendicular to a surface of the substrate and an insulator phase filling gaps of the columnar bodies, wherein the magnetic phase contains Fe and B (boron) and at least one of Nb, Zr, and Hf, and is amorphous, and has in-plane uniaxial anisotropy of $Hk2/Hk1 \geqq 3$ and $Hk2 \geqq 3.98 \times 10^3$ A/m when a minimal anisotropic magnetic field in a plane parallel to the surface of the substrate is Hk1 and a maximal anisotropic magnetic field is Hk2.

An antenna system in an aspect of the present invention includes a feed terminal, an antenna element whose one end is connected to the feed terminal, and a high-frequency magnetic material for suppressing transmission losses of electromagnetic waves radiated from the antenna element, wherein the high-frequency magnetic material includes a substrate and a composite magnetic film formed on the substrate and made of a magnetic phase forming a plurality of columnar bodies whose longitudinal direction is directed in a direction perpendicular to a surface of the substrate and an insulator phase filling gaps of the columnar bodies and the magnetic phase contains Fe and B and at least one of Nb, Zr and Hf, and is amorphous, and has in-plane uniaxial anisotropy of $Hk2/Hk1 \geqq 3$ and $Hk2 \geqq 3.98 \times 10^3$ A/m when the minimal anisotropic magnetic field in a plane parallel to the surface of the substrate is Hk1 and the maximal anisotropic magnetic field is Hk2.

DETAILED DESCRIPTION OF THE EMBODIMENTS

The inventors found that by containing Fe and B and at least one of Nb, Zr and Hf in a magnetic phase, the magnetic phase can be made amorphous with a small amount of added elements, magnetic anisotropic dispersion can be suppressed while maintaining high permeability and also the loss component of permeability can be reduced more than a composite magnetic film having a crystalline columnar structure in a high-frequency region. The present invention is completed based on the above findings made by the inventors.

Amorphous herein refers to a state in which the half width of the strongest peak of Fe in X ray diffraction using CuKα rays is 3.0 or more.

First Embodiment

A high-frequency magnetic material in the first embodiment of the present invention includes a substrate and a composite magnetic film formed on the substrate and made of a magnetic phase forming a plurality of columnar bodies whose longitudinal direction is directed in a direction perpendicular to a surface of the substrate and an insulator phase filling gaps of the columnar bodies. In addition, the magnetic phase contains Fe and B. And the magnetic phase also contains at least one of Nb, Zr and Hf. And the magnetic phase is amorphous, and has in-plane uniaxial anisotropy of $Hk2/Hk1 \geqq 3$ and $Hk2 \geqq 3.98 \times 10^3$ A/m when a minimal anisotropic magnetic field in a plane parallel to the surface of the substrate is Hk1 and a maximal anisotropic magnetic field is Hk2.

Figure 1A:
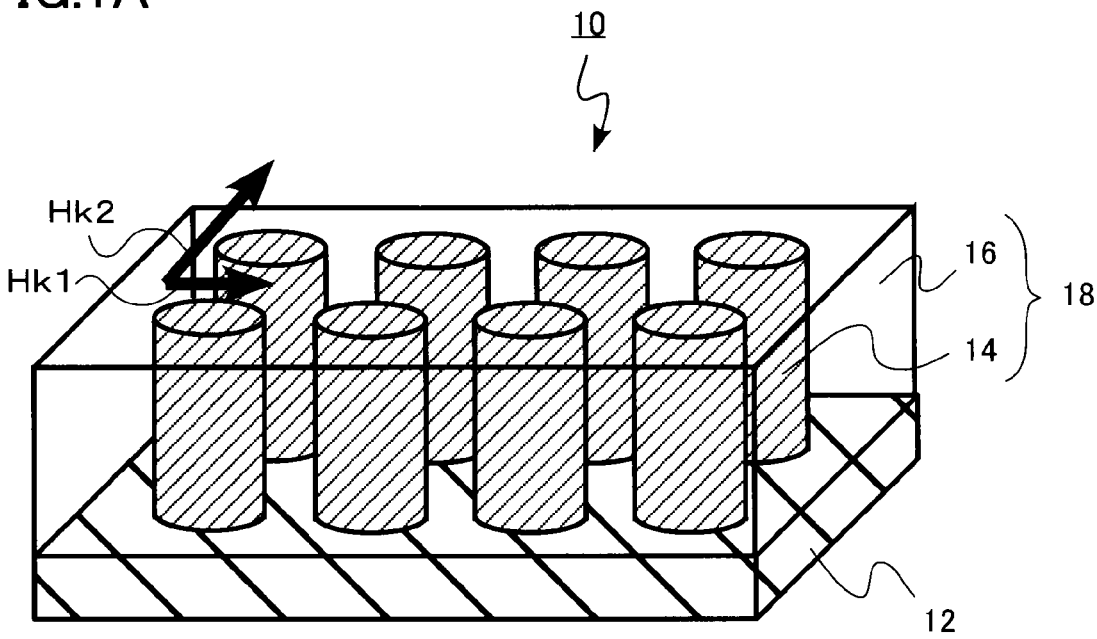
FIG. 1 is a perspective view and a top view of a high-frequency magnetic material in a first embodiment.
Figure 1B:
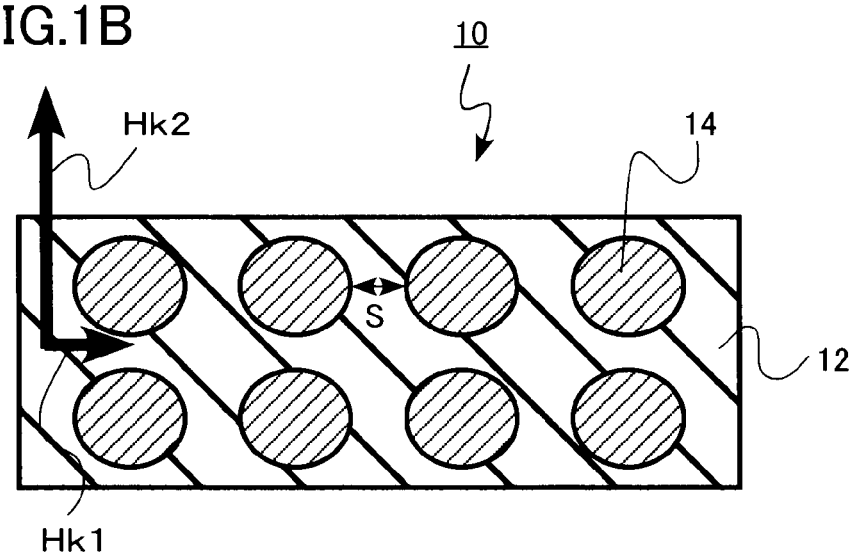

FIG. 1 is a diagram showing the structure of a high-frequency magnetic material in the present embodiment. FIG. 1A is a perspective view and FIG. 1B is a top view.

A high-frequency magnetic material 10 illustrated in FIG. 1 has a magnetic phase 14 forming on a substrate 12 a plurality of columnar bodies whose longitudinal direction is directed in the direction perpendicular to the surface of the substrate 12. The magnetic phase 14 contains at least one of Nb, Zr, and Hf, and Fe and B. In addition, the magnetic phase 14 is amorphous.

Nb, Zr, and Hf produce an effect of raising the crystallization temperature of Fe. B produces an effect of making Fe amorphous by entering space between lattices of Fe. Thus, by adding both elements to Fe, Fe can be made amorphous efficiently with a small amount of added elements. If the amount of added elements is small, the proportion of Fe increases so that permeability can be made higher. Also, if the amount of added elements is small, disturbances of the columnar structure itself can be suppressed so that a loss component of permeability can be reduced. In addition, by making the magnetic phase 14 amorphous, magnetic anisotropic dispersion can be suppressed while maintaining high permeability and also the loss component of permeability can be reduced more than a composite magnetic film having a crystalline columnar structure.

A ratio x of a total of Nb, Zr, and Hf contained in the magnetic phase 14 is preferably 1 at $\% \leqq x \leqq 7$ at %. If x is less than 1 at %, the effect of raising the crystallization temperature of Fe will be small, making Fe less likely to be amorphous. If x is more than 7 at %, the crystallization temperature of Fe will be constant, causing a possibility of lower permeability due to a smaller proportion of Fe despite more addition of metal.

A ratio y of B contained in the magnetic phase 14 is preferably 5 at $\% \leqq y \leqq 20$ at %. If y is less than 5 at %, Fe is less likely to become amorphous. If y is more than 20 at %, the proportion of Fe becomes smaller, leading to lower permeability or an increase in loss component of permeability due to disturbances of the columnar structure.

Moreover, if a metal becomes amorphous, electric resistivity can be made larger than that of the crystalline metal. That is, by making the magnetic phase amorphous columnar bodies, an excellent high-frequency magnetic material showing high permeability, low loss, and high resistivity in a high-frequency region can be produced.

As shown in FIG. 1A and FIG. 1B, the high-frequency magnetic material 10 has in-plane uniaxial anisotropy of $Hk2/Hk1 \geqq 3$ and $Hk2 \geqq 3.98 \times 10^3$ A/m (=50 Oe) when the minimal anisotropic magnetic field in a plane parallel to the surface of the substrate is Hk1 and the maximal anisotropic magnetic field is Hk2.

A high-frequency magnetic material according to the present embodiment can reduce the loss component of permeability in a high-frequency region by including in-plane uniaxial anisotropy in the above range.

Why the loss component of permeability in a high-frequency region is enabled to be reduced in a high-frequency region by having in-plane uniaxial anisotropy can be considered as follows: The maximal anisotropic magnetic field and a resonance frequency of permeability are in a proportional relationship and the resonance frequency of 1 GHz or more can be achieved by setting $Hk2 \geqq 3.98 \times 10^3$ A/m. Then, in order to attain $Hk2 \geqq 3.98 \times 10^3$ A/m, it is effective to provide in-plane uniaxial anisotropy satisfying $Hk2/Hk1 \geqq 3$. By having in-plane uniaxial anisotropy, as described above, the maximal anisotropic magnetic field can be made larger than when magnetic properties are isotropic and, as a result, $\mu''/\mu'$ in a high-frequency region can be made smaller.

If the magnetic phase contains at least one of Nb, Zr and Hf, and Fe and B, is amorphous, and includes in-plane uniaxial anisotropy satisfying $Hk2/Hk1 \geqq 3$ and $Hk2 \geqq 3.98 \times 10^3$ A/m when the minimal anisotropic magnetic field in a plane parallel to the surface of the substrate is Hk1 and the maximal anisotropic magnetic field is Hk2, as described above, the loss component of permeability in a high-frequency region can greatly be reduced compared with a conventional magnetic material.

FIG. 1 exemplifies an elliptical columnar body whose section perpendicular to the longitudinal direction of the columnar body of the magnetic phase 14 has an elliptical shape, but in addition to the elliptical columnar body, other shapes such as a cylindrical body, a square columnar body, a hexagonal columnar body, and an octagonal columnar body are also allowed.

An insulator phase 16 is formed between these columnar bodies. A portion combining the magnetic phase 14 and the insulator phase 16 is called a composite magnetic film 18.

It is preferable that $5\ \text{nm} \leqq D \leqq 20\ \text{nm}$ and $D/S \geqq 4$ be satisfied when an average value of a diameter at a bottom of one columnar body in the magnetic phase 14 is D and that of an interval between the columnar bodies is S (FIG. 1B). Here, arbitrary two locations on the surface parallel to the substrate of the high-frequency magnetic material are observed using a transmission electron microscope (of a magnification of 400,000 times). Then, the maximal and minimal diameters at each bottom of all columnar bodies included in a range corresponding to 100 nm in four directions from the center of each observation photograph are measured and the average value of all these values is set as D. If apparently a columnar body formed by a plurality of columnar bodies being coalesced is present, such a columnar body shall be excluded from measurement. A total of 20 columnar bodies, 10 from each location, is randomly selected from 100 nm in four directions from the center of the observation photograph at two locations described above and intervals between each columnar body and adjacent columnar bodies are measured to set the average value of all measured values as S.

If D is smaller than 5 nm, it becomes more difficult to form a columnar body, leading to a lower volume percentage of the magnetic phase 14 in a high-frequency magnetic material and lower permeability. If D is larger than 20 nm, coercive force becomes larger, leading to an increase in loss of permeability. If D/S is smaller than 4, the volume percentage of the magnetic phase 14 may decrease, leading to lower permeability.

The ratio of the height to the diameter (aspect ratio) of a columnar body is preferably 5 or more. Here, the diameter is the average value D of diameters at the bottom of columnar bodies. Also, arbitrary two locations perpendicular to the substrate of the high-frequency magnetic material are observed using a transmission electron microscope (of a magnification of 400,000 times). Then, a total of 20 columnar bodies, 10 from each location, is selected in descending order of height (length) in each observation photograph to define the average value of heights thereof as the height of the columnar bodies.

If the aspect ratio is smaller than 5, the insulator phase 16 will be present also between bottoms of columns, leading to lower permeability due to lower volume percentage of the magnetic phase 14. FIG. 1A illustrates only one columnar body in a direction perpendicular to the surface of the substrate 12. However, a plurality of columnar bodies may actually be arranged in the direction perpendicular to the surface of the substrate 12, sandwiching the insulator phase 16 in the longitudinal direction of the columnar bodies.

In the composite magnetic film 18, a ratio P of an area occupied by the magnetic phase 14 in a plane parallel to the surface of the substrate 12 is preferably $75\% \leqq P \leqq 95\%$. If P is less than 75%, the volume percentage of the magnetic phase 14 may decrease, leading to lower permeability. If P is more than 95%, columnar bodies may condense to make D larger than 20 nm, increasing the loss of permeability, as described above.

If the magnetic phase 14 is denoted as M, the insulator phase 16 as I, and the composite magnetic film 18 as $M_zI_{(1-z)}$, $0.80 \leqq z \leqq 0.95$ is preferably satisfied, that is, the ratio of the magnetic phase occupied in the composite magnetic film is preferably 80 mol % or more and 95 mol % or less. If the magnetic phase 14 is less than 80 mol %, the volume percentage of the magnetic phase 14 may decrease to build a granular structure, leading to lower permeability. If the magnetic phase 14 is more than 95 mol %, columnar bodies may condense to make D larger than 20 nm, increasing the loss of permeability, as described above.

A high-frequency magnetic material according to the present embodiment can be manufactured by forming a composite magnetic film by the sputtering method, electron-beam evaporation method or the like on a substrate. By rotating the substrate and controlling film formation conditions, magnetic in-plane uniaxial anisotropy in a plane parallel to the surface of the substrate can effectively be provided to the composite magnetic film formed on the substrate.

For example, plastics such as polyimide, inorganic material such as $SiO_2$, $Al_2O_3$, MgO, Si, and glass can be used as a substrate according to the present embodiment. However, the material of the substrate is not limited to these materials.

As shown in FIG. 1, the magnetic phase in the present embodiment has a structure of columnar bodies whose longitudinal direction is directed in the direction perpendicular to the surface of the substrate. However, longitudinal direction of columnar bodies may partially be permitted to tilt at an angle of ±30°, preferably ±10° with respect to the direction perpendicular to the surface of the substrate.

That columnar bodies of the magnetic phase 14 are amorphous can be determined from X ray diffraction patterns and electron diffraction patterns. In X ray diffraction patterns, instead of sharp strong peaks like those of a crystal, broad weak peaks appear. In electron diffraction patterns, instead of distinct spots, halo rings appear. As described above, amorphous herein refers to a state in which the half width of the strongest peak of Fe in X ray diffraction using CuKα rays is 3.0 or more.

Particularly, a half width F is preferably $3.5 \leqq F \leqq 5.5$. This is an area of amorphous much closer to crystalline. If the magnetic phase is crystalline, magnetic anisotropy can be provided more easily and the resonance frequency becomes higher, but due to disturbances of crystalline orientation (that is, polycrystal), magnetic anisotropic dispersion arises, increasing the loss component of permeability (imaginary part μ"). If the magnetic phase is amorphous, magnetic anisotropic dispersion resulting from disturbances of crystalline orientation is extremely small because there is no crystalline orientation, but due to difficulty of providing magnetic anisotropy, the resonance frequency may decrease, leading to an increase in loss component of permeability in a high-frequency region. By making the magnetic phase amorphous much closer to crystalline, a material having both a high resonance frequency, which is an advantage of crystalline, and small magnetic anisotropic dispersion, which is an advantage of amorphous, and whose loss component of permeability in a high-frequency region is very small can be produced. In the present invention, by controlling film formation conditions by adjusting the amounts of added elements x and y in the above ranges, an excellent high-frequency magnetic material whose loss component of permeability is small can be produced. If F is smaller than 3.5, crystallization proceeds and, if F is larger than 5.5, amorphization proceeds. In both cases, an increase in loss component of permeability in a high-frequency region could be caused.

It is preferable that the magnetic phase contain Co to further increase permeability and the ratio of Co to the whole magnetic phase is preferably 20 at % or more and 40 at % or less.

As shown in FIG. 1, the insulator phase in the present embodiment fills gaps of columnar bodies of the magnetic phase 14. In terms of suppressing transmission losses caused by an eddy current, the material of the insulator phase 16 preferably has electric resistivity of $1\times10^2$ Ωcm or more at room temperature.

The material of the insulator phase 16 may include oxide, nitride, carbide, and fluoride of metal selected, for example, from a group consisting of Mg, Al, Si, Ca, Cr, Ti, Zr, Ba, Sr, Zn, Mn, Hf, and rare earth elements (including Y). In terms of ease and costs of film formation, particularly oxide, among others, silicon oxide and aluminum oxide are preferable.

The insulator phase 16 permits inclusion of 30 mol % or less of magnetic metal elements. If the amount of magnetic metal elements exceeds 30 mol %, electric resistivity of the insulator phase 16 may decrease, leading to reduced magnetic properties of the whole composite magnetic film.

Next, magnetic in-plane uniaxial anisotropy of a composite magnetic film according to the present embodiment will be described. The composite magnetic film 18 shown in FIG. 1 has the minimal anisotropic magnetic field Hk1 in a plane parallel to the surface of the substrate 12 and the maximal anisotropic magnetic field Hk2 in a direction perpendicular to Hk1 and has magnetic in-plane uniaxial anisotropy satisfying $Hk2/Hk1 \geqq 3$ and $Hk2 \geqq 3.98\times10^3$ A/m (=50 Oe).

By providing uniaxial anisotropy, the maximal anisotropic magnetic field can be made larger than when magnetic properties are isotropic, making it easier to obtain an anisotropic magnetic field of $3.98\times10^3$ A/m or more. The maximal anisotropic magnetic field and the resonance frequency of permeability are in a proportional relationship and setting $Hk2\geqq3.98\times10^3$ A/m makes it easier to attain the resonance frequency of 1 GHz or more. In order to attain $Hk2\geqq3.98\times10^3$ A/m, it is effective to provide uniaxial anisotropy satisfying $Hk2/Hk1\geqq3$. By providing uniaxial anisotropy and making the maximal anisotropic magnetic field larger, as described above, $\mu''/\mu'$ in a high-frequency region can be made smaller.

Figure 2:
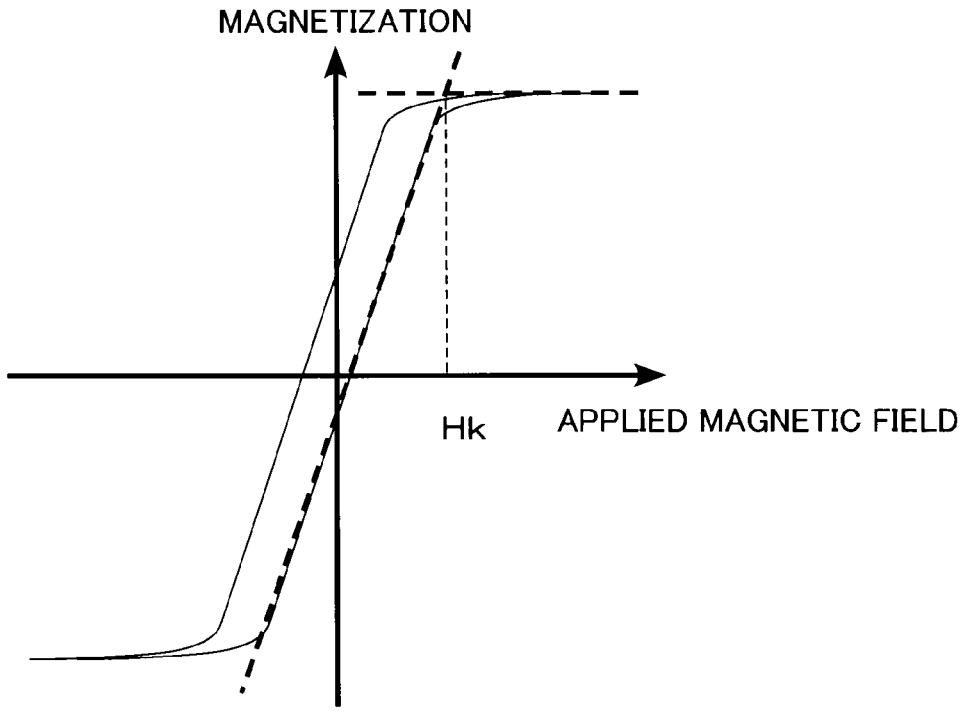
FIG. 2 is a graph showing an applied magnetic field dependence of magnetization.

As shown in FIG. 2, Hk (Hk1 and Hk2) is defined herein as a magnetic field at the intersection of a tangent in a magnetic field in which the amount of magnetization changes to an applied magnetic field is the largest ($\geqq0$) and that in a magnetic field in which the magnetization amount of changes is the smallest in the first quadrant (magnetization>0, applied magnetic field>0) of a magnetization curve.

Such magnetic anisotropy can be realized, for example, by making the diameter in the direction corresponding to the anisotropic magnetic field Hk1 of a columnar body on the surface of the composite magnetic film 18 longer and that in the direction corresponding to the anisotropic magnetic field Hk2 shorter.

Magnetic anisotropy can also be provided by changing the amount of magnetic elements in the insulator phase 16. Magnetic anisotropy can be realized, for example, by making columnar bodies in the direction corresponding to the anisotropic magnetic field Hk1 on the surface of the composite magnetic film 18 have more magnetic elements in the insulator phase 16 than those in the direction corresponding to the anisotropic magnetic field Hk2.

It is also possible to provide magnetic anisotropy by making the interatomic distance of Fe in the direction corresponding to the anisotropic magnetic field Hk1 on the surface of the composite magnetic film 18 longer than that of Fe in the direction corresponding to the anisotropic magnetic field Hk2.

The high-frequency magnetic material 10 according to the present embodiment permits formation of a thin film layer containing a different material from that of the composite magnetic film 18 between the substrate 12 and the composite magnetic film 18. When the composite magnetic film 18 is formed on such a thin film layer, the high-frequency magnetic material 10 having further improved magnetic properties can be obtained, for example, by being able to control the diameter of columnar bodies in the magnetic phase 14 of the composite magnetic film 18 and reducing disturbances of a magnetic structure at an interface between the substrate 12 and the composite magnetic film 18.

The thin film layer is preferably selected from Ni, Fe, Cu, Ta, Cr, Co, Zr, Nb, Ru, Ti, Hf, W, Au, or an alloy thereof, or an oxide such as $SiO_2$ and $Al_2O_3$.

Then, the thin film layer preferably has a thickness of 50 nm or less. If the thickness of the thin film layer exceeds 50 nm, there is a possibility that the volume percentage of the magnetic phase 14 in the high-frequency magnetic material decreases, leading to lower permeability.

The high-frequency magnetic material preferably has high resistivity in a high-frequency region to suppress transmission losses caused by an eddy current. It is effective to cut a slit in the material to make resistivity of the high-frequency magnetic material higher. Generation of an eddy current can be suppressed by cutting a slit at intervals of 100 to 1000 μm and making the high-frequency magnetic material finer.

Second Embodiment

A high-frequency magnetic material according to the second embodiment of the present invention is the same as that according to the first embodiment except that the composite magnetic film further includes an insulator layer parallel to a substrate. Therefore, a description of portions that overlap with those of the first embodiment is omitted below.

Figure 3:
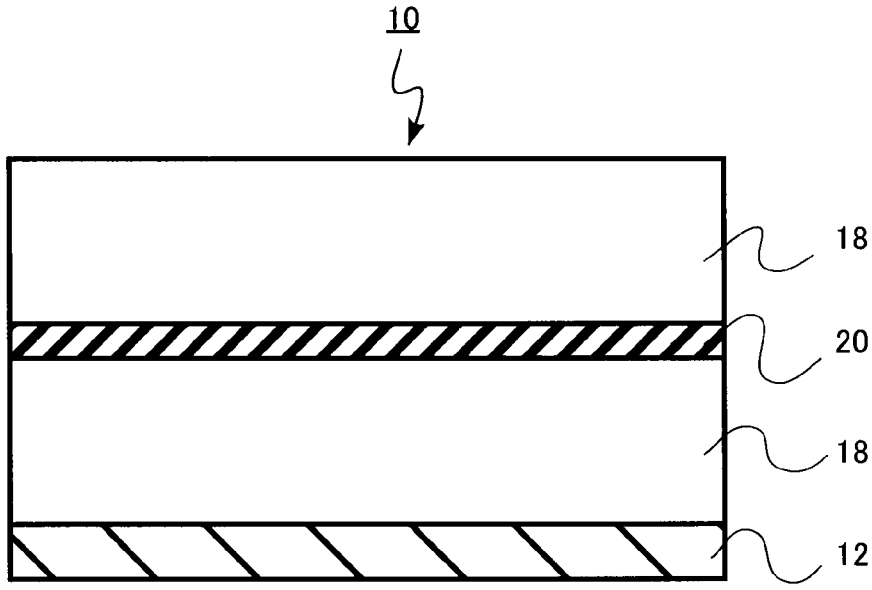
FIG. 3 is a sectional view of a high-frequency magnetic material in a second embodiment.

FIG. 3 is a sectional view of a high-frequency magnetic material in the present embodiment. As shown in FIG. 3, the high-frequency magnetic material in the present embodiment has a structure in which at least two layers of the composite magnetic film 18 are laminated on the substrate 12 and an insulator layer 20 is formed between these composite magnetic films 18.

By causing the insulator layer 20 to lie between two or more layers of the composite magnetic film 18, that is, by making the film thicker by separating the composite magnetic film 18 in the thickness direction through the insulator layer 20, it becomes possible to reduce an influence of a demagnetizing field generated when the composite magnetic film 18 is made thicker without causing the insulator layer 20 to lie in the composite magnetic film 18 and to improve magnetic properties of the whole high-frequency magnetic material 10. Also, disturbances of the structure in the thickness direction that could occur when the composite magnetic film 18 is made thicker can also be avoided. FIG. 3 shows one layer of the insulator layer 20, but a plurality of insulator layers may be present.

The insulator layer 20 is preferably made of at least one selected, for example, from a group of oxide, nitride, carbide, and fluoride of metal selected from a group of Mg, Al, Si, Ca, Cr, Ti, Zr, Ba, Sr, Zn, Mn, Hf, and rare earth elements (including Y). Particularly, it is preferable to select a material for the insulator layer 20 that is of the same kind as that of the insulator phase 16 constituting the composite magnetic film 18.

The insulator layer 20 has a thickness of 5 nm or more and 100 nm or less, preferably 50 nm or less. If the insulator layer 20 has the thickness exceeding 100 nm, the volume percentage of the magnetic phase in the high-frequency magnetic material 10 decreases, leading to lower permeability. If the insulator layer 20 has the thickness below 5 nm, there is a possibility that an influence of a demagnetizing field becomes more pronounced because magnetic coupling between the composite magnetic films 18 is not cut off.

Third Embodiment

An antenna system according to the third embodiment of the present invention includes a feed terminal, an antenna element whose one end is connected to the feed terminal, and a high-frequency magnetic material for suppressing transmission losses of electromagnetic waves radiated from the antenna element. Then, the high-frequency magnetic material is the high-frequency magnetic material described in the first embodiment or the second embodiment. Therefore, a description of the high-frequency magnetic material is omitted below due to an overlap with that of the high-frequency magnetic material in the first embodiment or second embodiment.

Figure 4:
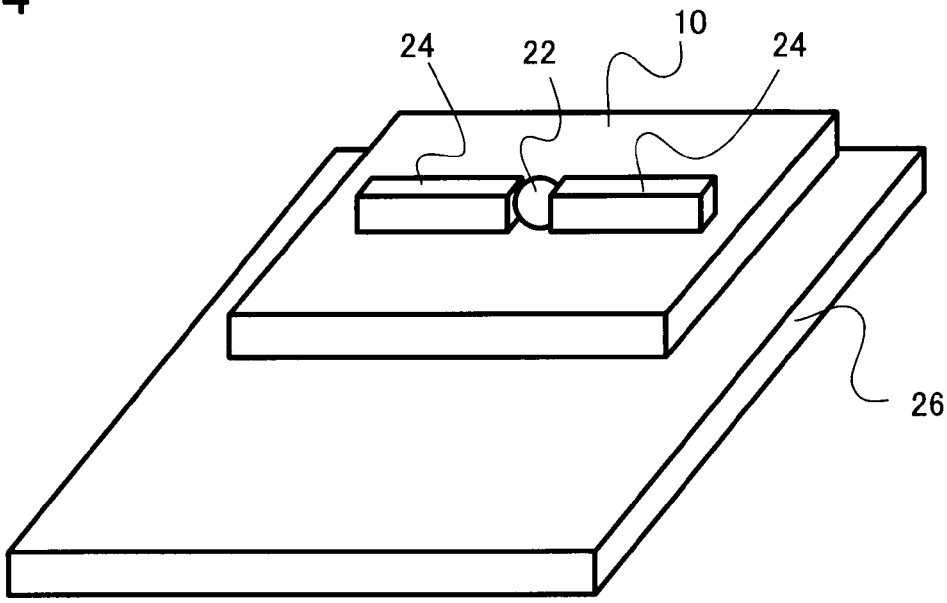
FIG. 4 is a perspective view of an antenna system in a third embodiment.
Figure 5:
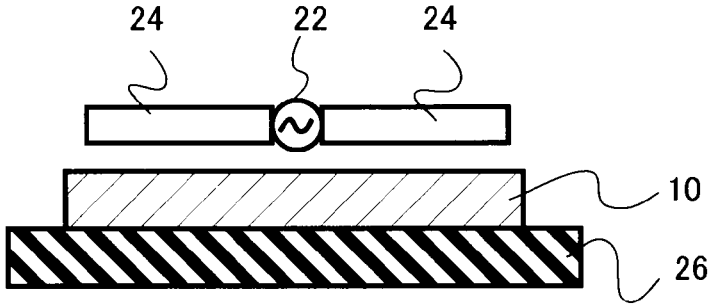
FIG. 5 is a sectional view of the antenna system in the third embodiment.

FIG. 4 is a perspective view of an antenna system according to the present embodiment and FIG. 5 is a sectional view thereof. The high-frequency magnetic material 10 is provided between antenna elements 24 whose one end is connected to a feed terminal 22 and a wired substrate 26. The wired substrate 26 is, for example, a wired substrate of a mobile device and is enclosed, for example, by a metallic chassis.

When an antenna of a mobile device radiates electromagnetic waves, for example, radiation of electromagnetic waves is disturbed by an induced current generated in a metal when the antenna and a metal such as a chassis of the mobile device come closer than a certain distance. However, if a high-frequency magnetic material is arranged near the antenna, no induced current is generated even if the antenna and the metal such as a chassis are brought closer so that radio frequency communication can be stabilized and the mobile device can be made smaller.

By inserting the high-frequency magnetic material 10 between the two antenna elements 24 sandwiching the feed terminal 22 and a wired substrate 9, like the present embodiment, an induced current generated in the wired substrate 26 is suppressed when electromagnetic waves are radiated by the antenna elements 24 so that radiation efficiency of the antenna system can be improved.

Embodiments of the present invention have been described above with reference to concrete examples. According to these embodiments, an excellent high-frequency magnetic material having a smaller ratio ($\mu''/\mu'$) of the real part $\mu'$ of permeability and the imaginary part $\mu''$ of permeability in a high-frequency region and an antenna system using thereof can be provided. The above embodiments are shown strictly as examples and do not limit the present invention. Though descriptions of parts in a high-frequency magnetic material, an antenna system using thereof and the like that were not directly necessary to describe the present invention were omitted when describing these embodiments, necessary components related to the high-frequency magnetic material or the antenna device using thereof can appropriately be selected and used.

In addition, all high-frequency magnetic materials equipped with components of the present invention and whose design can appropriately be modified by a person skilled in the art and antenna devices using thereof are included in the scope of the present invention. The scope of the present invention is defined by appended claims and equivalents thereof.

EXAMPLES

Examples of the present invention will be described below in detail.

Example 1

An opposed type magnetron sputter film formation apparatus was used. $Fe_{57.1}Co_{24.5}Nb_{3.4}B_{15}$—$SiO_2$ (the ratio x of Nb in the magnetic phase is 3.4 at %, the ratio y of B is 15 at %, and FeCoNbB to be the magnetic phase is 93 mol %, that is, z=0.93) was used as the target. A rotating holder was arranged inside a chamber and an $SiO_2$ substrate was fixed onto the holder. While rotating the substrate at 10 rpm, sputtered particles from the target were caused to deposit onto the substrate surface under pressure of 0.67 Pa ($5\times10^{-3}$ Torr) in an Ar atmosphere inside the chamber to form a composite magnetic film having a thickness of 0.42 μm.

Figure 6:
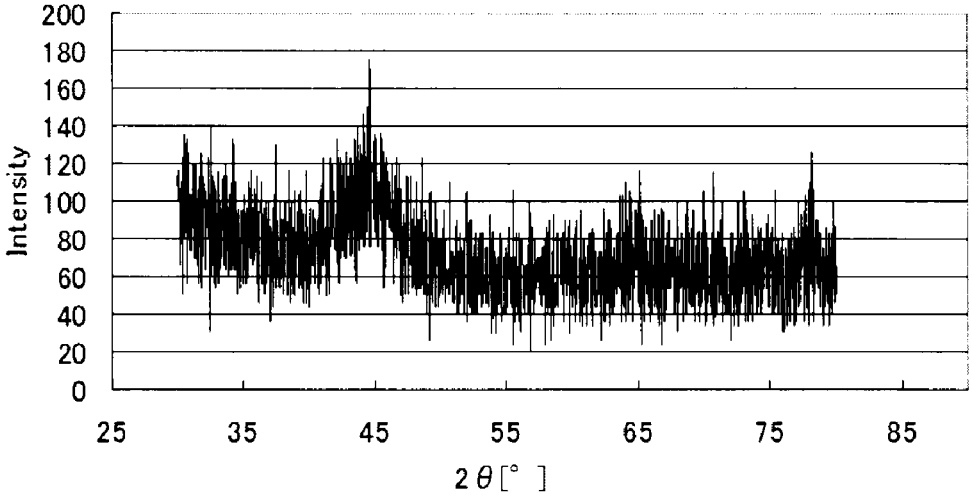
FIG. 6 is a graph showing an X ray diffraction pattern on a surface of a composite magnetic material in Example 1.

X ray diffraction measurement using CuKα rays (XRD) was made on the surface of the composite magnetic film. A measurement result is shown in FIG. 6. The half width F of a (110) peak of Fe near 2θ=45° is 5.04, showing that the film is in an amorphous state.

A plane parallel to the substrate surface of the composite magnetic film was observed under a transmission electron microscope (TEM) with two views (two photographs). The maximal and minimal diameters at the bottom of all columnar bodies included in a range corresponding to 100 nm in four directions from the center of each observation photograph were measured and an average value of all these values was calculated to obtain D=10 nm. Also, a total of 20 columnar bodies, 10 from each photograph, was randomly selected from the range corresponding to 100 nm in four directions from the center of each observation photograph and intervals between each columnar body and adjacent columnar bodies were measured and an average value of all these values was calculated to obtain S=1.1 nm. The ratio P of an area occupied by the magnetic phase was 92%.

Figure 7:
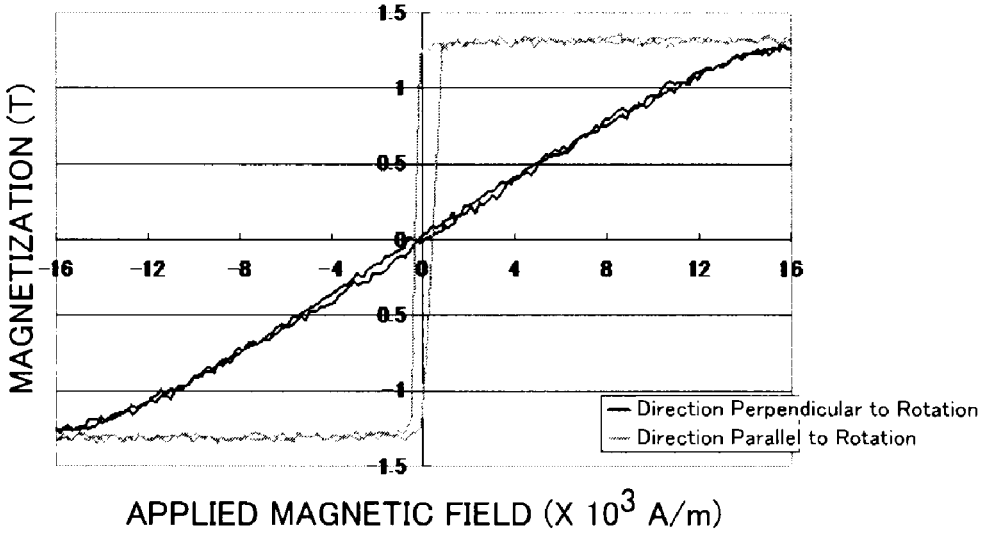
FIG. 7 is a graph showing VSM measurement results in Example 1.

A vibrating sample magnetometer (VSM) was used to measure magnetic properties (magnitude of magnetization with respect to an applied magnetic field) of the composite magnetic film in the direction parallel to the substrate rotation during film formation and in the direction perpendicular to the substrate rotation. FIG. 7 shows results thereof. The minimal anisotropic magnetic field Hk1 in the direction parallel to the substrate rotation was $0.41\times10^3$ A/m and the maximal anisotropic magnetic field Hk2 in the direction perpendicular to the substrate rotation was $14.2\times10^3$ A/m.

Figure 8:
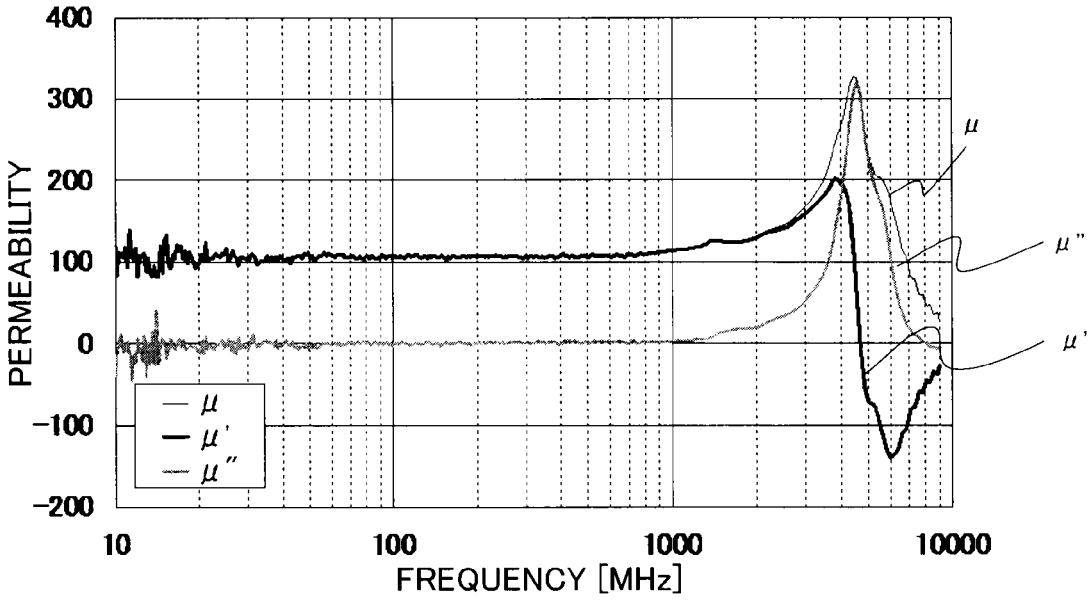
FIG. 8 is a graph showing high-frequency characteristic measurement results in Example 1.

A super-high frequency permeability measuring system PMM-9G1 manufactured by Ryowa Electronics was used to make measurement with magnetizing the composite magnetic film to the direction of the maximal anisotropic magnetic field in the range of 1 MHz to 9 GHz. FIG. 8 shows results thereof. The real part $\mu'$ of permeability at 1 GHz was 113.7, the imaginary part $\mu''$ of permeability showing a loss component of permeability at 1 GHz was 2.98, and $\mu''/\mu'$ showing magnetic properties at 1 GHz was 0.026. The above measurement results are summarized in Table 1.

Example 2

Film formation and measurement were performed in the same manner as in Example 1 except that Nb was replaced by Zr. Results thereof are listed in Table 1.

Example 3

Film formation and measurement were performed in the same manner as in Example 1 except that Nb was replaced by Hf. Results thereof are listed in Table 1.

Example 4

Film formation and measurement were performed in the same manner as in Example 1 except that x=3.6 at % and y=10 at % were set. Results thereof are listed in Table 1.

Example 5

Film formation and measurement were performed in the same manner as in Example 1 except that x=1 at % and y=20 at % were set. Results thereof are listed in Table 1.

Example 6

Film formation and measurement were performed in the same manner as in Example 1 except that x=7 at % and y=5 at % were set. Results thereof are listed in Table 1.

Example 7

Film formation and measurement were performed in the same manner as in Example 1 except that x=0.5 at % and y=15 at % were set. Results thereof are listed in Table 1.

Example 8

Film formation and measurement were performed in the same manner as in Example 1 except that x=8 at % and y=15 at % were set. Results thereof are listed in Table 1.

Example 9

Film formation and measurement were performed in the same manner as in Example 1 except that y=4 at % was set. Results thereof are listed in Table 1.

Example 10

Film formation and measurement were performed in the same manner as in Example 1 except that y=22 at % was set. Results thereof are listed in Table 1.

Example 11

Film formation and measurement were performed in the same manner as in Example 1 except that z=0.80 was set. Results thereof are listed in Table 1.

Example 12

Film formation and measurement were performed in the same manner as in Example 1 except that z=0.95 was set. Results thereof are listed in Table 1.

Example 13

Film formation and measurement were performed in the same manner as in Example 1 except that z=0.97 was set. Results thereof are listed in Table 1.

Comparative Example 1

Film formation and measurement were performed in the same manner as in Example 1 except that z=0.75 was set. The magnetic phase had a granular structure, instead of the columnar structure. Results thereof are listed in Table 1.

Comparative Example 2

Film formation and measurement were performed in the same manner as in Example 1 except that x=0 at % was set. Results thereof are listed in Table 1.

Comparative Example 3

Film formation and measurement were performed in the same manner as in Example 1 except that y=0 at % was set. The magnetic phase became crystalline. Results thereof are listed in Table 1.

Comparative Example 4

Film formation and measurement were performed in the same manner as in Example 1 except that the substrate was rotated at 5 rpm in the film formation. Results thereof are listed in Table 1.

Comparative Example 5

Film formation and measurement were performed in the same manner as in Example 1 except that the pressure was changed to 0.27 Pa ($2\times10^{-3}$ Torr) in an Ar atmosphere inside the chamber in the film formation. Results thereof are listed in Table 1.

TABLE 1

| | STRUCTURE | CRYSTALLINITY | x [at %] | y [at %] | z | D AVE. VALUE [nm] | S AVE. VALUE [nm] | D/S |
|---|---|---|---|---|---|---|---|---|
| EXAMPLE 1 | COLUMNAR | AMORPHOUS | 3.4 | 15 | 0.93 | 10 | 1.1 | 9.1 |
| EXAMPLE 2 | COLUMNAR | AMORPHOUS | 3.4 | 15 | 0.93 | 10 | 1.2 | 8.3 |
| EXAMPLE 3 | COLUMNAR | AMORPHOUS | 3.4 | 15 | 0.93 | 10 | 1.1 | 9.1 |
| EXAMPLE 4 | COLUMNAR | AMORPHOUS | 3.6 | 10 | 0.93 | 10 | 1.2 | 8.3 |
| EXAMPLE 5 | COLUMNAR | AMORPHOUS | 1 | 20 | 0.93 | 11 | 1.2 | 9.2 |
| EXAMPLE 6 | COLUMNAR | AMORPHOUS | 7 | 5 | 0.93 | 10 | 1.2 | 8.3 |
| EXAMPLE 7 | COLUMNAR | AMORPHOUS | 0.5 | 15 | 0.93 | 10 | 1.2 | 8.3 |
| EXAMPLE 8 | COLUMNAR | AMORPHOUS | 8 | 15 | 0.93 | 9 | 1.1 | 8.2 |
| EXAMPLE 9 | COLUMNAR | AMORPHOUS | 3.4 | 4 | 0.93 | 11 | 1.3 | 8.5 |
| EXAMPLE 10 | COLUMNAR | AMORPHOUS | 3.4 | 22 | 0.93 | 12 | 1.2 | 10.0 |
| EXAMPLE 11 | COLUMNAR | AMORPHOUS | 3.4 | 15 | 0.80 | 9 | 2.0 | 4.5 |
| EXAMPLE 12 | COLUMNAR | AMORPHOUS | 3.4 | 15 | 0.95 | 10 | 1.1 | 9.1 |
| EXAMPLE 13 | COLUMNAR | AMORPHOUS | 3.4 | 15 | 0.97 | 40 | 3.0 | 13.3 |
| COMPARATIVE EXAMPLE 1 | GRANULAR | AMORPHOUS | 3.4 | 15 | 0.75 | 30 | 10 | 3.0 |
| COMPARATIVE EXAMPLE 2 | COLUMNAR | AMORPHOUS | 0 | 15 | 0.93 | 10 | 1.1 | 9.1 |
| COMPARATIVE EXAMPLE 3 | COLUMNAR | CRYSTAL | 3.4 | 0 | 0.93 | 10 | 1.2 | 8.3 |
| COMPARATIVE EXAMPLE 4 | COLUMNAR | AMORPHOUS | 3.4 | 15 | 0.93 | 10 | 1.2 | 8.3 |
| COMPARATIVE EXAMPLE 5 | COLUMNAR | AMORPHOUS | 3.4 | 15 | 0.93 | 10 | 1.2 | 8.3 |

| | P [%] | F | Hk1 [$\times10^3$ A/m] | Hk2 [$\times10^3$ A/m] | Hk2/Hk1 | μ' | μ'' | μ''/μ' |
|---|---|---|---|---|---|---|---|---|
| EXAMPLE 1 | 92 | 5.04 | 0.41 | 14.2 | 34.6 | 113.7 | 2.98 | 0.026 |
| EXAMPLE 2 | 90 | 5.40 | 0.45 | 13.8 | 30.7 | 120.1 | 3.84 | 0.032 |
| EXAMPLE 3 | 92 | 5.21 | 0.45 | 14.0 | 31.1 | 119.5 | 3.94 | 0.033 |
| EXAMPLE 4 | 90 | 4.39 | 0.27 | 10.7 | 39.6 | 189.6 | 11.2 | 0.059 |

TABLE 1-continued

| | | | | | | | | |
|---|---|---|---|---|---|---|---|---|
| EXAMPLE 5 | 92 | 5.43 | 0.55 | 9.98 | 18.1 | 135.5 | 8.26 | 0.061 |
| EXAMPLE 6 | 90 | 3.55 | 0.43 | 8.24 | 19.2 | 141.2 | 9.88 | 0.070 |
| EXAMPLE 7 | 90 | 5.32 | 0.61 | 7.13 | 11.7 | 129.7 | 23.3 | 0.18 |
| EXAMPLE 8 | 90 | 4.95 | 0.43 | 14.0 | 32.6 | 97.4 | 10.7 | 0.11 |
| EXAMPLE 9 | 90 | 3.40 | 0.69 | 6.37 | 9.2 | 165.0 | 29.7 | 0.18 |
| EXAMPLE 10 | 92 | 5.61 | 1.01 | 12.1 | 12.0 | 120.6 | 11.4 | 0.095 |
| EXAMPLE 11 | 80 | 5.23 | 0.48 | 13.9 | 29.0 | 109.9 | 5.17 | 0.047 |
| EXAMPLE 12 | 92 | 5.15 | 0.45 | 14.1 | 31.3 | 111.3 | 4.23 | 0.038 |
| EXAMPLE 13 | 88 | 3.95 | 1.48 | 4.46 | 3.0 | 170.8 | 34.2 | 0.20 |
| COMPARATIVE EXAMPLE 1 | 70 | 6.40 | 1.30 | 5.88 | 4.5 | 103.3 | 64.0 | 0.62 |
| COMPARATIVE EXAMPLE 2 | 92 | 6.03 | 1.19 | 4.91 | 4.13 | 218.8 | 73.6 | 0.34 |
| COMPARATIVE EXAMPLE 3 | 90 | 0.46 | 0.98 | 8.84 | 9.0 | 200.3 | 62.1 | 0.31 |
| COMPARATIVE EXAMPLE 4 | 90 | 5.07 | 1.80 | 5.04 | 2.8 | 253.4 | 88.7 | 0.35 |
| COMPARATIVE EXAMPLE 5 | 90 | 5.19 | 3.18 | 3.18 | 1.0 | 98.0 | 91.2 | 0.93 |

The composite magnetic film in Example 1 contains at least one of Nb, Zr, and Hf, and Fe and B (boron) and has an amorphous columnar structure and, as is evident from Table 1, the imaginary part μ" of permeability (loss component of permeability) at 1 GHz and the ratio (μ"/μ') of the real part of permeability and the imaginary part of permeability at 1 GHz are smaller than those of Comparative Example 1 having the granular structure, Comparative Example 2 containing none of Nb, Zr, and Hf, Comparative Example 3 containing no B and having a crystalline columnar structure, and Comparative Examples 4 and 5 satisfying Hk2/Hk1<3 and Hk2<$3.98\times10^3$ A/m, showing that the composite magnetic film in Example 1 has superior magnetic properties in a high-frequency region.

Examples 1 to 6, 11 and 12 in which the ratio x of Nb, Zr, or Hf contained in the magnetic phase is 1 at %≦x ≦7 at % and the ratio y of B contained in the magnetic phase is 5 at %≦y≦20 at % have lower μ"/μ' than that of Examples 7 to 10 and Comparative Examples 2 and 3 in which these values deviate from these ranges, showing that the composite magnetic film in these examples has superior magnetic properties in a high-frequency region.

Examples 1 to 6, 11 and 12 in which the ratio z of the magnetic phase is 0.80≦z≦0.95, 5 nm≦D≦20 nm, D/S ≧4, and 75%≦P≦95% have lower μ"/μ' than that of Example 13 and Comparative Example 1 in which these values deviate from these ranges, showing that the composite magnetic film in these examples has superior magnetic properties in a high-frequency region.

Examples 1 to 6, 11 and 12 in which the half width F of the strongest peak of Fe by X ray diffraction using CuKα rays is 3.5≦F≦5.5 have lower μ"/μ' than that of Examples 9 and 10 in which this value deviates from the range, showing that the composite magnetic film in these examples has superior magnetic properties in a high-frequency region.

Accordingly, an effect of the present invention has been confirmed by these examples.

What is claimed is:

1. A high-frequency magnetic material, comprising:

a substrate; and a composite magnetic film formed on the substrate and made of a magnetic phase forming a plurality of columnar bodies whose longitudinal direction is directed in a direction perpendicular to a surface of the substrate and an insulator phase filling gaps of the columnar bodies, wherein the magnetic phase contains Fe and B (boron) and at least one of Nb, Zr and Hf, and is amorphous and has in-plane uniaxial anisotropy of Hk2/Hk1≧3 and Hk2≧$3.98\times10^3$ A/m when a minimal anisotropic magnetic field in a plane parallel to the surface of the substrate is Hk1 and a maximal anisotropic magnetic field is Hk2.

2. The material according to claim 1, wherein a ratio x of a total of Nb, Zr, and Hf contained in the magnetic phase is 1 at %≦x≦7 at % and a ratio y of B contained in the magnetic phase is 5 at %≦y≦20 at %.

3. The material according to claim 1, wherein when an average value of a diameter at a bottom of the columnar bodies is D and that of an interval between the columnar bodies is S, 5 nm≦D≦20 nm and D/S≧4 are satisfied, and a ratio P of an area occupied by the magnetic phase in a plane parallel to the surface of the substrate is 75%≦P≦95%.

4. The material according to claim 1, wherein when the magnetic phase is denoted as M, the insulator phase as I, and the composite magnetic film as $M_zI_{(1-z)}$, 0.80≦z≦0.95 is satisfied.

5. The material according to claim 1, wherein a half width F of a strongest peak of Fe by X ray diffraction using CuKα rays is 3.5≦F≦5.5.

6. The material according to claim 1, wherein an average value of a ratio of a height of the columnar bodies to a diameter thereof is 5 or more.

7. The material according to claim 1, wherein the magnetic phase further contains Co and the insulator phase contains at least an oxide.

8. The material according to claim 7, wherein a ratio a of Co contained in the magnetic phase to the whole magnetic phase is 20 at %≦a≦40 at %.

9. The material according to claim 1, wherein the composite magnetic film further comprising an insulator layer parallel to the substrate.

10. The material according to claim 9, wherein a thickness of the insulator layer is 5 nm or more and 100 nm or less.

11. An antenna system, comprising:

a feed terminal;

an antenna element whose one end is connected to the feed terminal; and a high-frequency magnetic material for suppressing transmission losses of electromagnetic waves radiated from the antenna element, wherein the high-frequency magnetic material comprises a substrate and a composite magnetic film formed on the substrate and made of a magnetic phase forming a plurality of columnar bodies whose longitudinal direction is directed in a direction perpendicular to a surface of the substrate and an insulator phase filling gaps of the columnar bodies and the magnetic phase contains Fe and B and at least one of Nb, Zr and Hf, and is amorphous, and has in-plane uniaxial anisotropy of $Hk2/Hk1 \geqq 3$ and $Hk2 \geqq 3.98 \times 10^3$ A/m when a minimal anisotropic magnetic field in a plane parallel to the surface of the substrate is Hk1 and a maximal anisotropic magnetic field is Hk2.

12. The system according to claim 11, wherein a ratio x of a total of Nb, Zr, and Hf contained in the magnetic phase is 1 at $\% \leqq x \leqq 7$ at % and a ratio y of B contained in the magnetic phase is 5 at $\% \leqq y \leqq 20$ at %.

13. The system according to claim 11, wherein when an average value of a diameter at a bottom of the columnar bodies is D and that of an interval between the columnar bodies is S, $5\ nm \leqq D \leqq 20\ nm$ and $D/S \geqq 4$ are satisfied, and a ratio P of an area occupied by the magnetic phase in a plane parallel to the surface of the substrate is $75\% \leqq P \leqq 95\%$.

14. The system according to claim 11, wherein when the magnetic phase is denoted as M, the insulator phase as I, and the composite magnetic film as $M_zI_{(1-z)}$, $0.80 \leqq z \leqq 0.95$ is satisfied.

15. The system according to claim 11, wherein a half width F of a strongest peak of Fe by X ray diffraction using CuKα rays is $3.5 \leqq F \leqq 5.5$.

16. The system according to claim 11, wherein an average value of a ratio of a height of the columnar bodies to a diameter thereof is 5 or more.

17. The system according to claim 11, wherein the magnetic phase further contains Co and the insulator phase contains at least an oxide.

18. The system according to claim 17, wherein a ratio a of Co contained in the magnetic phase to the whole magnetic phase is 20 at $\% \leqq a \leqq 40$ at %.

19. The system according to claim 11, wherein the composite magnetic film further comprising an insulator layer parallel to the substrate.

20. The system according to claim 19, wherein a thickness of the insulator layer is 5 nm or more and 100 nm or less.

* * * * *